US005131787A

United States Patent [19]

Goldberg

[11] Patent Number: 5,131,787

[45] Date of Patent: Jul. 21, 1992

[54] TIRE MAT AND METHOD OF CONSTRUCTION

[76] Inventor: Jerry Goldberg, 462 Arbor Cir., Youngstown, Ohio 44505

[21] Appl. No.: 578,881

[22] Filed: Sep. 7, 1990

[51] Int. Cl.[5] ..... E01C 5/18; E01C 5/16; E01C 7/00

[52] U.S. Cl. ..... 404/32; 404/35; 404/71

[58] Field of Search ..... 404/35, 36, 32, 33, 404/28, 70, 71, 16, 17

[56] References Cited

U.S. PATENT DOCUMENTS

| | | | |
|---|---|---|---|
| 3,850,537 | 11/1974 | Bynum, Jr. | 404/17 |
| 4,067,197 | 1/1978 | Ritter | 404/35 X |
| 4,142,821 | 3/1979 | Doring . | |
| 4,152,875 | 5/1979 | Soland | 404/35 X |
| 4,801,217 | 1/1989 | Goldberg | 404/35 X |
| 4,850,738 | 7/1989 | Niemi . | |

FOREIGN PATENT DOCUMENTS

| | | |
|---|---|---|
| 55-9924 | 1/1980 | Japan . |
| 61-1712 | 1/1986 | Japan . |

*Primary Examiner*—Ramon S. Britts
*Assistant Examiner*—Nancy Connolly
*Attorney, Agent, or Firm*—Clifford A. Poff

[57] ABSTRACT

A method of forming and the construction of a temporary roadway mat system, comprising a number of longitudinally arrays of overlapping on-road truck tire sidewalls, the arrays covering the expected width of the roadway and being supported from beneath by a floor member made up of a number of relatively flatly arranged on-road truck tread portions, in which the sidewalls are connected together and also connected to the tread portions to create a strong unitary floatational instant roadway surface over unstable ground.

29 Claims, 4 Drawing Sheets

TIRE MAT AND METHOD OF CONSTRUCTION

BACKGROUND OF THE INVENTION

In the construction, mining, farming, logging and other industries, it is sometimes necessary to build a temporary roadway over unstable ground surfaces, such as that found in swamps or other areas formed of muskeg and in sand. A method such as that disclosed in my U.S. Pat. No. 4,801,217 was developed for building roads over such unstable ground surfaces, wherein sections of mats of inter-connected tire sidewall elements are laid over the unstable ground surface, the mats acting to distribute the weight of a vehicle traveling over the mat sections in a manner to prevent the mat sections from sinking into the unstable ground beneath. The mat system of my previous patent employed mainly the sidewall portions of discarded used tires, in which each sidewall was tied together by tire strips made of the casing of the tires or by other suitable tying means. While such systems have proven very successful for many applications, in certain applications and from a cost standpoint there is a need to improve the previous tire mat systems. One such need has reference to handling greater road loading for longer trouble free service at a saving in manufacturing, assembling, installing and maintenance costs. Another is the need to find a solution for the ever increasing ecological problem presented by the tread portions of the discarded tires, in which regard, there is a great need to find a high volume use, not only for the sidewall portions of the tires, but also for the entire tire, including the tread portion thereof.

SUMMARY OF THE INVENTION

The present invention provides a tire mat system and method of construction thereof that makes use of the entire refused or discarded used tires, such as discarded on-road truck tires. The mat system of the present invention has the advantage of providing, over previous known mat systems, a mat system that provides a substantial increased long-life load carrying capacity, greater stability and superior floatation ability at a substantial savings in cost, both from the standpoint of a supplier and of the user thereof.

One form of the present invention provides an instant road tire mat system and method of construction thereof, comprising a plurality of arrays of generally side by side parallelly arranged sidewall portions, the sidewall portions of each array and the sidewall portions of adjacent arrays being substantially overlapped in two different directions.

Another form of the present invention provides an instant road tire mat system and method of construction thereof, comprising a plurality of arrays of generally parallelly arranged sidewall tire portions, at least one relatively flat continuous tire tread portion arranged co-extensive with the sidewall portions in a contacting and supporting relationship therewith, the sidewall and tread portions being constructed to create a section of a temporary roadway over which heavy loaded vehicles are allowed to pass.

In the preferred form of the present invention, the arrays are made up of a series of sidewall portions, overlapped in two different directions and in a substantial manner, in which the sidewall portions are interconnected by connecting means to adjacent sidewall portions and to adjacent portions of at least two tread portions, the substantially co-extensive in length tread portions being arranged in a floor like fashion directly beneath the sidewall portions and held in their supporting and carrying relation by restraining members, the entire system having a number of parallelly arranged arrays extending the total width of the roadway.

A further object of the present invention is to arrange the sidewall portions so that the tread portions fall substantially in the center area of the sidewall portions and wherein the entire mat system is formed generally by at least two thickness sidewalls and the adjacent inside edge area of the overlapping sidewall portions form more than two thickness sidewalls, and further wherein certain portions of the surfaces of the sidewalls form load carrying ramps for the wheels of a vehicle in a desired direction of travel thereof.

It is another object of the present invention to arrange the sidewall portions with their bead portions arranged "up", and wherein the treads of the tread portions are arranged to physically engage the original outside adjacent surfaces of the sidewall portions to assist in securing them to the tread portions and in resisting movement of the sidewall portions.

It is another object of the invention to provide for several tire tread portions to be physically connected together to form a desired mat length and width and to arrange and connect the sidewall portions of an inner arrays to overlap the sidewall portions of the adjacent outer arrays in the area where the wheels of the vehicle may pass, and wherein the sidewall portions of each array are also arranged and connected in an overlapping relation in a manner to reduce the area of the openings formed by the overlapped adjacent sidewall portions in the area where the wheels of the vehicle may pass.

BRIEF DESCRIPTION OF THE DRAWINGS

These objects, as well has other novel features and advantages of the present invention will be better understood when the following descriptions of a preferred and second embodiments are read along with the following drawings, of which.

DETAILED DESCRIPTION OF THE INVENTION

Figure 1:
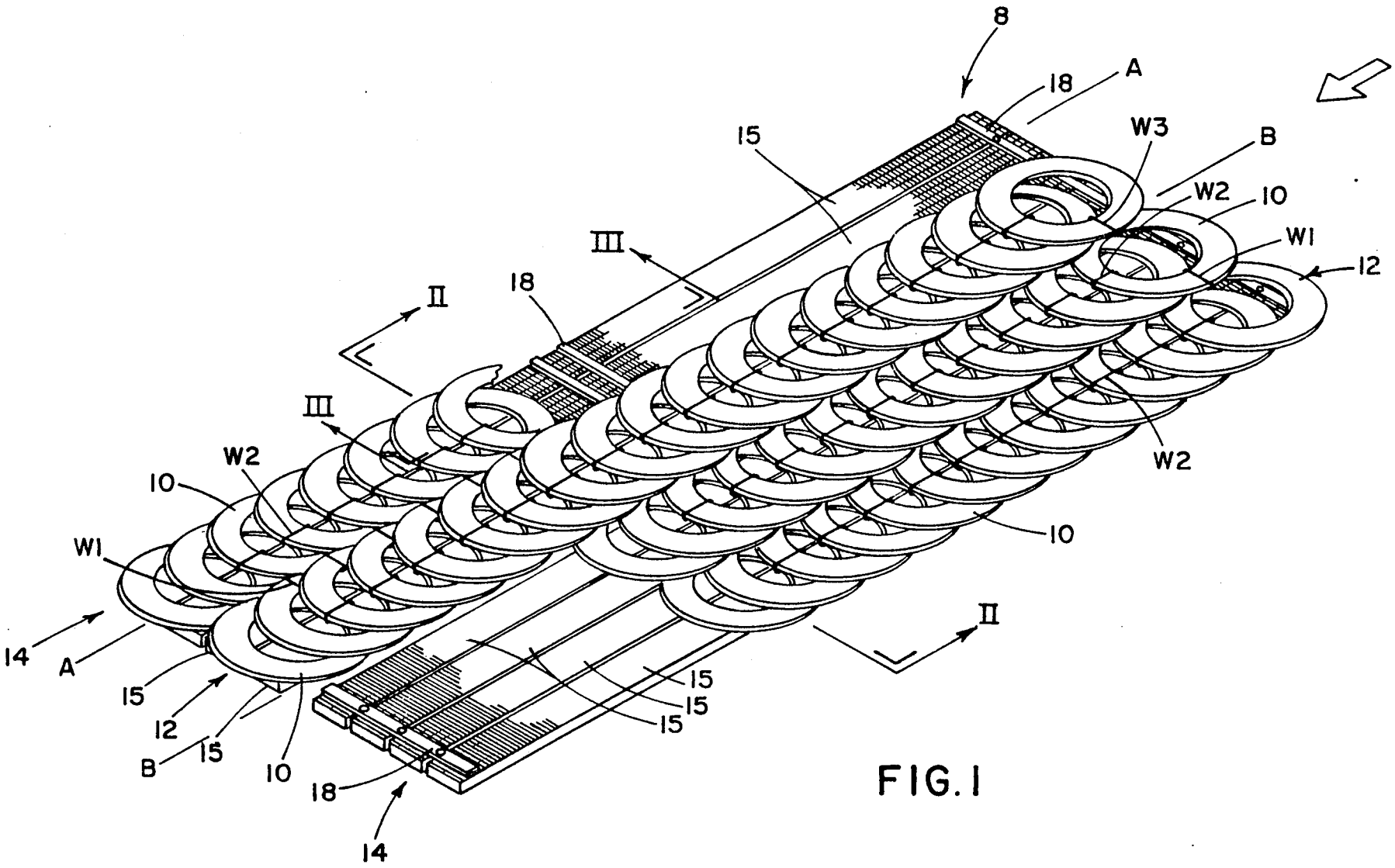
FIG. 1 is an isometric schematic view of a tire mat system constructed in accordance to the present invention.

With reference to FIG. 1, there is illustrated a tire mat system 8 designed to utilize refused or discarded used tires of on-road trucks, particularly the entire tire, i.e. both the sidewall and tread portions. As used herein, the terms sidewall and sidewall portion are meant to refer to both the commonly referenced inside diameter bead portion and the portion between the bead portion and the outside diameter commonly referenced tread portion of the tire but excluding the tread portion. In FIG. 1, the temporary road supporting system comprises sidewall portions 10 obtained by cutting the opposed sidewalls from the tread in a well known manner from discarded on-road truck tires as taught generally in my earlier U.S. Pat. No. 4,801,217. The sidewall portions are arranged with their normal inside surfaces facing upwardly, i.e. as they appear in the assembled tires, as one views FIGS. 1, 2 and 3 to be contacted by the tires of the vehicles that will pass over the mat system. By arranging the inside surfaces "up" any objectionable collection of water will be avoided, which otherwise may occur if the sidewalls were reversed. More importantly, however, the "up" positioning presents an upwardly inclined tapered ramp surface of the sidewall so that the wheel or wheels of a truck traveling in the "loaded" direction roll up the taper, which may be better appreciated by looking at FIGS. 1A and 1B, particularly the latter figure showing a wheel in contact with the tapered surface of a sidewall and part of the action on the affected portion of the sidewall and tread portion being forced into the ground. By reason of this action the tendency of the rotation of the driven wheels to expel the contacted sidewalls and pull the mat apart is resisted. While automobile sidewalls and treads can be used, the use of the separated components of on-road truck tires is preferred when very large truck or other vehicles are to be supported by the mat system.

The individual sidewalls 10 are formed into four side by side arranged arrays 12, each array consisting of approximately 18 sidewalls arranged in the in-line overlapping illustrated fashion of FIG. 1, the 18 sidewalls giving an approximate 20 foot mat length. In the use of popular size on-road truck tires, the sidewalls will measure between 20 inches to 24.5 inches inside or bead diameter, the sidewall width of the illustrated sidewalls each being approximately between 6 to 9 inches, given a mat width of approximately 9 foot 6 inches, when the overlapped condition is taken into account. This overlap, in the illustrated construction, is approximately the full width of the sidewalls, which as noted is between 6 to 9 inches.

In the preferred use, and while both bias ply and radial tires can be used, the mat should be formed uniformly of one type and of one relatively narrow range of sizes, for example 20 inches to 22 inches sidewall diameters. Also attention should be given to the desire to adhere to general uniformity in the concentricity and width of the sidewalls. In FIG. 1, there is illustrated four arrays 12 of sidewalls 10, the aggregate width thereof being designed to slightly exceed the widest wheel-base of the vehicle expected to use the tire mat roadway.

Figure 1A:
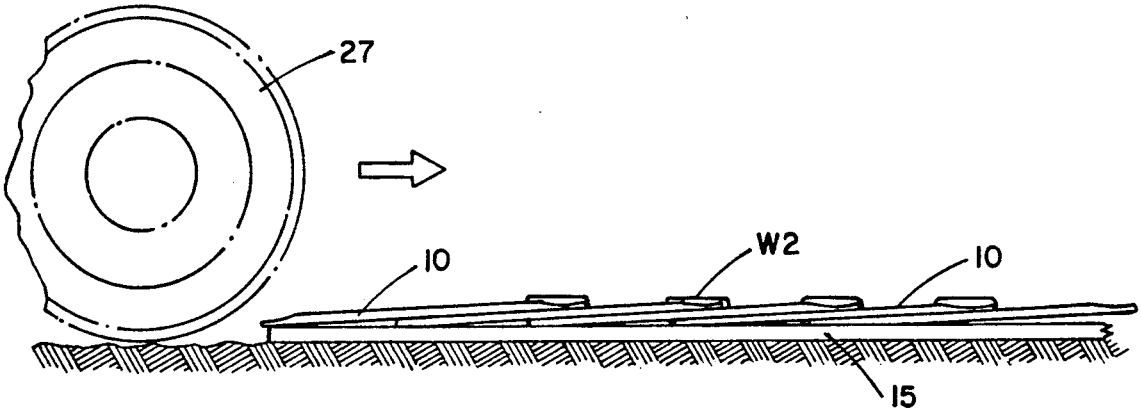
FIG. 1A is a partial sectional view of one of the sidewalls shown in FIG. 1 in its unloaded condition.
Figure 1B:
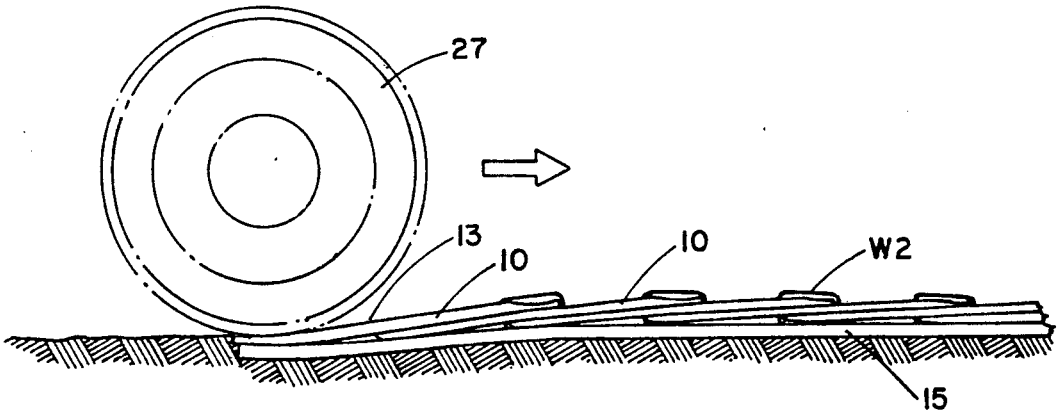
FIG. 1B is a view similar to FIG. 1A, but with the sidewall in a loaded condition.
Figure 2:
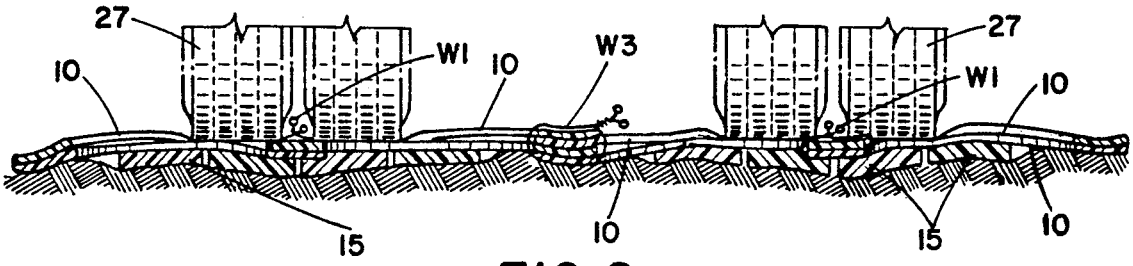
FIG. 2 is a sectional view taken on line 2—2 of FIG. 1.
Figure 3:
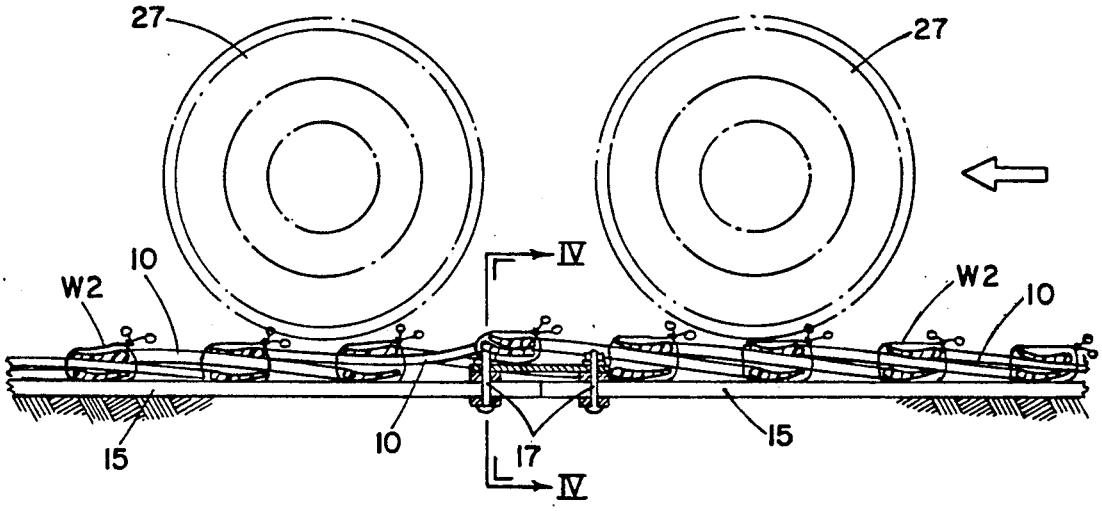
FIG. 3 is a sectional view taken on line 3—3 of FIG. 1.

As shown in FIG. 3, the sidewalls of each array in the lengthwise direction of the mat 8 are arranged in a substantially overlapping fashion, this overlap being created by placing the "top" sidewall so that its bead portion is exposed, i.e., faces away from the ground, and extends to generally the center of the supporting sidewall where the opening of the "bottom" sidewall is approximately divided in half transversely. This bead portion being the thickest cross section portion of the sidewall provides a substantial supportive bridge between the opposed sides of the bottom sidewall openings when the mat is contacted by the wheels of a vehicle. As noted above, when the sidewalls are so positioned the upper outside portion of the sidewall extending away from the bead portion forms a downwardly inclined load carry surface or ramp 13 between the bead portion and the roadway, as shown in FIG. 1A and 1B. As FIG. 2 illustrates, the sidewalls of the two sets of outer and next adjacent arrays 12 are also overlapped in the transverse direction, with the inner sidewalls arranged to rest on the upper adjacent surfaces of the outer associated sidewalls, although the reverse may be employed. The overlapping sidewall portions formed by the two longitudinal arrays create substantially thick multi-sidewall sections to be contacted by the wheels of the passing vehicle.

In this regard the mat system provides roadway surfaces for the wheels at each side of the truck made up by the two sets of transverse overlapping arrays, in which for all practical purposes a portion of each sidewall has an overlapping relation with one or more portions of adjacent sidewalls. In this manner there is generally provided at least two thicknesses of sidewalls over the entire mat system, as at tract lane A in FIG. 1, and where the sidewalls overlap inwardly of the sides of the mat system the sidewalls have four thicknesses as at tract lane B in FIG. 1C. In addition, and particularly in hauling activities involving extreme terrain and surface conditions and where the trucks are heavily loaded two relatively closely spaced apart tract lanes are provided, one being the beaded tract lanes, the other the closely inner arranged multi thickness sidewall tract lanes. In the illustrated embodiment, the transverse overlap measures between 6 to 9 inches when the width of the mat measures approximately 9 foot 6 inches, depending on the size of the tires being used.

FIGS. 1, 2 and 3 also show the use of steel wire to inter-connect the sidewalls, in which in examining the upper two most horizontal rows there is shown horizontal and vertical "wire ties" W1 and W2, respectively, at generally 3 and 9 and 6 and 12 o'clock positions, which connecting system is used throughout the mat 8. In the system shown, the wire being used is a carbon steel 6½ gauge wire. The connections created by the wire is such as to allow the required deflections of the sidewalls when subject to loading but yet provide the necessary firm holding force between the sidewalls and the arrays to assure a relatively rigid stable structure.

The sidewalls of the two inner adjacent arrays are also connected together by wire. The sidewalls of these two arrays in addition to being connected by wire generally at the 6 and 12 o'clock positions are connected horizontally at generally the 3 and 9 o'clock positions by wire W3 to the adjacent sidewalls, in which direction the sidewalls of each inner array lie next to each other and exert on each other and the entire mat a tension holding action through the wires W1, W2 and W3 whereby the mat functions as an integral flexible floatable unit. In some applications a limited number of wires W3 may only be used to connect the two sets of arrays for handling of the mats and thereafter removed.

Each inter-connected sidewall outer-inner set that makes up the mat structure is supported for beneath by two flexible generally horizontally disposed floor members 14. Each floor member 14 is made up, in the example given herein, of four flatly arranged truck tire tread portions 15. In certain arrangements only a single tread portion may be used for an array. The tread portions are formed by cutting transversely the tread portions of the tire to produce a flat extending member, equal in length to the original circumference of the tire. Thus, only three cutting operations are involved on a given tire, two cuts to separate the two sidewalls from the tread portion and a third transverse cut of the tread to form a single flat tread portion. The tread portions 15 include the remaining opposed rounded sections of the tire that originally joined the tread to the sidewalls.

The tread portions are arranged with the tread "up" in physical contact with the sidewalls thereby creating a friction holding influence between the two elements. The tread portions 15 placed in this condition have their natural curl directed toward the ground, thereby the received load or weight is more evenly distributed and a positive sidewall holding force is created, in which the tread portions are constantly urged against the sidewalls. As to the rounded sections of the tread portions, the tread portions being arranged with the openings of their "U" shape sections facing downwardly eliminate the collection of water that would otherwise occur if reversed. Also, the rounded sections of the tread portions allow a relatively close aligned relationship to be established and maintained between adjacent tread portions when the tread portions are secured together in a side by side condition, thereby in addition to increasing the strength and floatation ability of the mat system, allow the floor members 14 to act as integral but flexible units.

Figure 4:
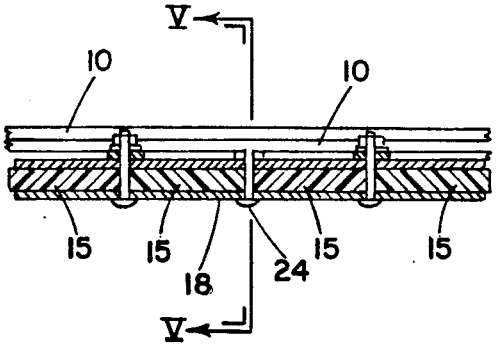
FIG. 4 is a sectional view taken on line 4—4 of FIG. 3.
Figure 5:
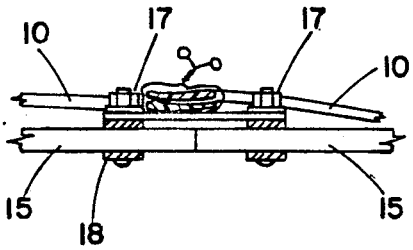
FIG. 5 is a sectional view taken on line 5—5 of FIG. 4.

Depending on the desired length of the mat system, two or more tread portions will be used to create the desired total length needed for an array of sidewalls 10. The tread portions 15 are connected together by abutting their ends and securing the end portions by upper and lower steel bars 16, fastened together by several bolts and nuts 17, as shown in FIGS. 3 and 5. The tread portions 15 that make up each floor member 14 are placed in a relatively close side by side edge fashion. The tread portions are held in this position by upper and lower steel bars 18, by bolts and nuts 24, as shown in FIG. 4. A bar assembly is provided at the opposite ends of each floor member 14 and at the center where two tread portions are joined together. The sidewalls 10 supported by each floor member 14 are secured to the adjacent areas of the floor member by steel wire W4 of the same type noted above used for inter-connecting the sidewalls to each other.

The floor members 14 are adopted to be placed on the unstable ground and serve as an instant road bed for a temporary roadway over which heavy and continuous loaded vehicles will pass. Thus, the present invention provides an instant roadway, such as a logging road, in which there is no need generally to cover the mat with dirt, gravel, or other forms of ballast etc. as was the usual practice in the past. This is an important feature of the present invention, both from the ability to create an instant roadway and from a cost standpoint, in that no ballast like material is required in order to be able to handle heavy loaded vehicles in a trouble free manner for extended period in off-road terrain conditions.

Figure 1C:
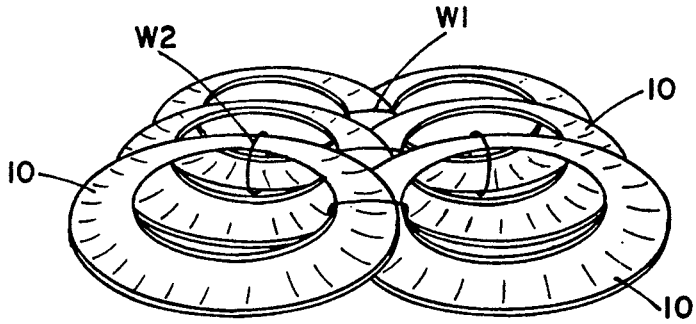
FIG. 1C is a partial isometric view showing the overlapped relationship of four sidewalls.

When a truck, for example, carrying a load is driven across the mat system in the direction of the arrows shown in FIGS. 1 and 3, the vehicle wheels may pass over generally any transverse portion of the mat but preferably over either the aligned longitudinal bead tract lane A or the overlapped outer and next adjacent arrays where the sidewalls overlap at tract lane B. In the direction of travel shown in FIG. 1, the tandem wheels 27 (FIG. 2) of a truck are illustrated passing over the multi-thickness area formed by several of the sidewalls, in which in certain areas, as noted, there may be as many as four overlapped sidewalls, as shown in FIG. 1C and generally never less than two. In this area of the mat, the outside arrays are "inclined" in the longitudinal direction of travel, as one views FIG. 2, and the inside arrays are "inclined" in the transverse direction, in which the tilted positions of the inner sidewalls provide an added section of immediate flexibility and rebound to the repeated loading of the mat. Should the truck pass in the bead lane areas, the thick sectioned beads which span the openings of the bottom sidewalls will provide additional support as assisted by the rest of the integral mat.

Since the sidewalls are ballast free, the load in the form of compression forces is taken directly into the overlapped zones formed by the overlapped sidewalls and the two overlapped arrays through the permitted and controlled deflections of the sidewalls and the load is distributed uniformly into the sidewalls that are subject to the loading and the adjacent sidewalls that are tied to the ones under the load. This action is repeated throughout the mat as the wheels move along the mat. What prevents, in part, the sections of the outer and next adjacent arrays from sinking into the unstable ground over which the mat is placed in the section of the two arrays that at the moment are not subject to the load and the permitted and controlled flexibility and hence floatation ability of these sections. This flexibility and floatation allows the sections not under loading to deflect upwardly when the loaded sections are force by the load downwardly into the unstable ground. This floatation feature is also substantially aided by the additional construction relationship of the floor members in cooperation with the supported arrays.

Figure 6:
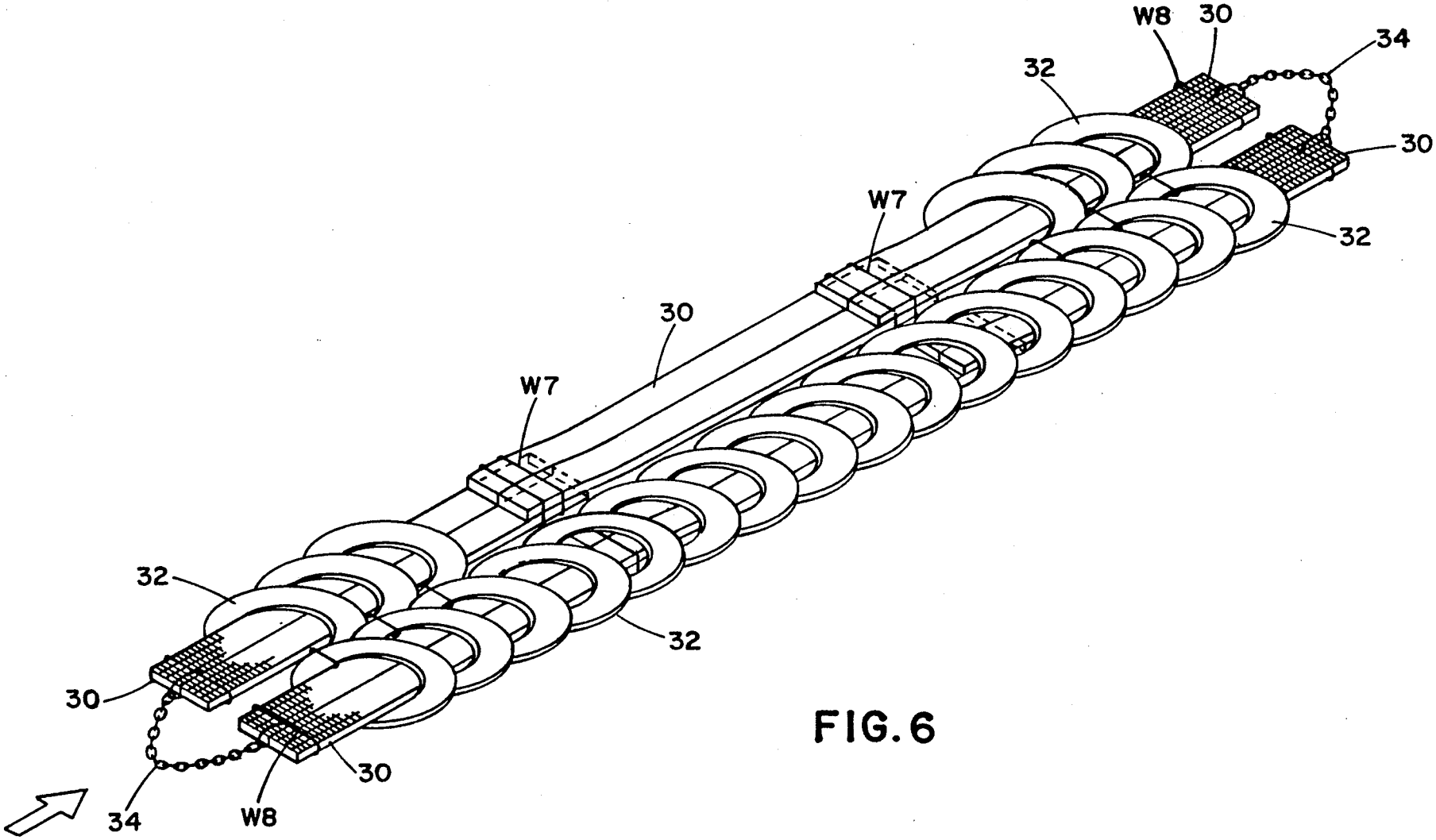
FIG. 6 is an isometric schematic view of a second embodiment of the present invention.

Turning now to FIG. 6, which illustrates a second embodiment of the present invention, in which only one set of arrays of sidewalls that makes up a mat that may be positioned under one of the wheels of a vehicle is shown, it being understood that the sidewalls and arrays will otherwise follow the teaching of FIGS. 1 and 2 unless otherwise noted. In the embodiment of FIG. 6, two identical side by side co-extensively arranged on-road truck tire tread portions 30 are located in the center of the openings of two in line arrays of longitudinally arranged sidewalls 32. The tread portions of the treads are arranged to engage the adjacent surfaces of the outside sidewall surfaces to maximize the frictional holding forces between the sidewalls and tread portions. The sidewalls 32 of each array are inter-connected by steel wire W5 of the type described earlier in connection with FIGS. 1 and 2, and in addition are "wire tied" to the tread portions as indicated by wire W6. Also the trades are wired together by wire W7 and at their opposed ends pull chains 34 are connected to the treads to enable them to be pulled into a desired position. In the case were only a single array and tread portion are used each tread portion may be provided with an individual chain. While the two independent set of arrays can be placed in the road tract areas of the roadway, if desired they can be tied together as shown in FIG. 1.

One use of a mat system constructed in accordance with the teaching of the present invention may be explained as follows: When employed as a logging roadway, once the trees in the path of the temporary roadway are removed and the stumps cut to grade a series of mats arranged in tandem fashion with their adjacent ends overlapped sufficient to provide a continuous wheel tract can be placed directly on the forest floor to provide an instant logging roadway, the mats furnishing a system of enhanced strength, long life and floatation ability. Mats constructed according to the present invention allows several options in creating the final assemblage of the required mat sections to cover the roadway area in question. The mat sections can be assembled by arranging and connecting their individual components at the temporary roadway site or may be preassembled in whole or in part and brought to the site for installation and/or completion of the assemblage.

While the invention has been described with reference to the two disclosed embodiments, it will be appreciated by those skilled in the art that the invention may take different forms than what is herein described and used for different purposes than the uses described. By way of example only and not limitation, two separate sets of spaced apart arrays can be arranged in the road tract lanes where the two sidewalls of the inner arrays are made to overlap the sidewalls of the outer array, the two sets of arrays need not be inter-connected or overlapped and a single array or a set thereof may be used only in the road tract lanes. The degree of overlap may be different than what has been illustrated. Moreover, instead of four side by side arrays, additional side by side arrays may be employed as an integral mat systems. Also automobile tire sidewalls and treads may be used depending on the application of the mat system.

I claim:

1. A mat system for creating a temporary instant roadway surface over unstable ground, comprising:

a number of parallelly arranged arrays of tire sidewalls disposed in a generally common longitudinal direction, each said sidewalls of a given array in said longitudinal direction being arranged to have a first overlapping relation within the longitudinal array, in which only a portion of one of adjacent sidewalls overlaps in said longitudinal direction of the roadway by an amount sufficient to establish a bridge portion of an overlying sidewall traversing over the central opening of lower most and underlying sidewall said sidewalls of adjacent arrays have a second overlapping relation, in which portions of adjacent sidewalls of adjacent arrays overlap substantially in a generally transverse direction relative to said longitudinal direction, and means for securing said sidewall to adjacent sidewalls to form an integral mat unit.

2. A mat system for creating a temporary instant roadway surface over unstable ground, comprising:

an array of tire sidewalls disposed in a generally common longitudinal direction, each said sidewalls of a given array being arranged to have an overlapping relation, in which portions of adjacent sidewalls generally overlap in said longitudinal direction of the roadway a sufficient amount to provide a bridge portion over the central open portions of lower most sidewalls, said sidewalls of adjacent arrays have a second overlapping relation, in which portions of adjacent sidewalls of adjacent arrays overlap substantially in a generally transverse direction relative to said longitudinal direction, a floor mat member discrete from the unstable ground of the roadway surface arranged beneath said array for supporting said array, and means for securing said sidewalls to form an integral mat unit.

3. At mat system for creating a temporary instant roadway surface over unstable ground, comprising:

a number of parallelly arranged arrays of tire sidewalls disposed in a generally common longitudinal direction, each said sidewalls of a given array being arranged to have a first overlapping relation, in which portions of adjacent sidewalls generally overlap in said longitudinal direction of the roadway a sufficient amount to provide a bridge portion over the central open portions of lower most sidewalls, said sidewalls of adjacent arrays overlap substantially in a generally transverse direction relative to said longitudinal direction, a floor mat member discrete from the ground of the roadway surface arranged beneath at least some of said arrays for supporting said particular arrays, and means for securing said sidewalls to form an integral mat unit.

4. A mat system according to claim 3, wherein said floor member comprising a tire tread portion having a length in said longitudinal direction substantially equal to the length of said arrays.

5. A mat system for creating a temporary instant roadway surface over unstable ground, comprising:

a number of parallelly arranged arrays of tire sidewalls disposed in a general common longitudinal direction, each said sidewalls of a given array being arranged to have a first overlapping relation, in which portions of adjacent sidewalls generally overlap in said longitudinal direction of the roadway a sufficient amount to provide a bridge portion over the central open portions of lower most sidewalls, said sidewalls of adjacent arrays have a second overlapping relation, in which portions of adjacent sidewalls of adjacent arrays overlap substantially in a generally transverse direction relative to said longitudinal direction, a floor member arranged beneath at least some of said arrays for supporting said particular arrays, said floor member comprising a number of side by side closely arranged tire tread portions having a length in said longitudinal direction substantially equal to the length of said arrays, and means for securing said sidewalls to form an integral mat unit.

6. A mat system according to claim 5, wherein said securing means includes, first means for securing said tread portions to each other, and second means for securing said sidewalls to adjacent sidewalls to form an flexible generally integral mat unit.

7. A mat system according to claim 5, wherein said sidewalls have face surfaces and said overlapping conditions are such that said sidewalls in said first direction overlap to approximately one half of the next adjacent sidewall and in said second direction overlap to the extent of substantially their entire said face surfaces.

8. A mat system according to claim 5, wherein said sidewalls have bead portions and said sidewalls in said first direction overlap to an extent that said bead portions are located to substantially divide the openings of said adjacent sidewalls to provide bridge portions across said openings.

9. A mat system according to claim 5, wherein said means for securing said sidewalls to each other include means for securing said tread portions to said sidewalls and comprises wire means of a nature that can be wrapped securely around said sidewalls and said tread portions.

10. A mat system according to claim 5, wherein said tread portions each includes a tread surface, and said tread surfaces arranged in a contacting relationship with adjacent surfaces of said sidewalls.

11. A mat system according to claim 5, wherein each said tread portion comprises at least two in line tread sections, and said first securing means include separate means for securing said tread sections together.

12. A mat system according to claim 6, wherein said first securing means includes separate means for securing said side by side tread portions together as an integral unit.

13. A mat system according to claim 5, wherein said arrays are arranged in a set of at least two arrays of outer and inner arrays, and wherein in said second overlapping relation said sidewalls of said inner array overlap the adjacent sidewalls of said outer array, and said arrays being arranged relative to each other and the roadway so that said second overlapped condition is arranged to be located generally in the track lanes of the roadway.

14. A mat system according to claim 5, wherein said sidewalls have bead and side portions and said sidewall of said arrays arranged in said first direction are arranged to have their bead portions facing upwardly relative to the roadway surface and their side portions extending from said bead portions to the roadway surface to form inclined load carrying surfaces.

15. A mat system according to claim 5, wherein said arrays are separately arranged in at least two closely adjacent sets, each set comprising outer and adjacent inner arrays, wherein said sidewalls of said outer and inner arrays are arranged in said 5 first and said second overlapping relations and wherein said sidewalls of said inner adjacent arrays with respect to each other are arranged in a transverse overlapping relations relative to said first direction.

16. A mat system according to claim 5, wherein said sidewalls and tread portions are formed from on-road truck tires.

17. A mat system according to claim 5, wherein said tire tread portions are arranged to pass through at least some of the center openings of said sidewalls of said arrays.

18. In a method of laying a temporary roadway over unstable ground comprising the steps of:

forming a number of arrays of tire sidewalls by arranging the sidewalls in a spaced relationship with each other in the longitudinal direction of the roadway, placing a number of the arrays in a direction transverse of said longitudinal direction to form at least a part of the width of the roadway, substantially overlapping said sidewalls in a first overlapped relationship in said longitudinal direction only a portion one of adjacent sidewalls overlaps in said longitudinal direction of the roadway by an amount sufficient to establish a bridge portion of an overlying side wall traversing over the central opening of lower most and underlying sidewall, substantially overlapping said sidewalls in a second overlapping relationship in a direction transverse to said longitudinal direction, and securing said sidewalls together to form an integral mat unit.

19. In a method according to claim 18, the additional steps of:

arranging said sidewalls in said first overlapped relationship so that of the bead portions of the sidewalls face away from the roadway, and arranging said sidewalls in said second overlapping relationship to form several overlapping sidewalls, said bridges and said several overlapping sidewalls forming relatively closely spaced apart tract lanes for the wheels of a vehicle.

20. In a method of laying a temporary roadway over unstable ground comprising the steps of:

forming a number of arrays of tire sidewalls by arranging the sidewalls in a spaced relationship with each other in the longitudinal direction of the roadway, placing a number of the arrays in a direction transverse of said longitudinal direction to form generally the width of the roadway, substantially overlapping said sidewalls in a first overlapped relationship in said longitudinal direction, substantially overlapping said sidewalls in a second overlapping relationship in a direction transverse to said longitudinal direction, forming a floor member by placing a tire tread portion beneath at least some of said arrays, and said floor member being arranged beneath said arrays in a manner to support superimposed arrays.

21. In a method according to claim 20, the additional step of:

forming said arrays to have a length in said longitudinal direction substantially equal to the length of said arrays.

22. In a method according to claim 20, the additional steps of:

forming said floor member by placing a number of said tire tread portions in a side by side closely arranged relationship, and securing said tread portions to each other and said sidewalls to each other and to said tread portions in a manner to create an integral substantially rigid flexible and floatatable instant road mat.

23. In a method according to claim 20, wherein said sidewalls when used as part of a tire have inner surfaces, the additional steps of:

arranging each said sidewall which its inner surface positioned away from said floor member in said longitudinal direction and in a manner to overlap approximately one half of the next adjacent longitudinal said sidewall and in said transverse direction to overlap said adjacent sidewall to the extent of substantially the entire said adjacent contacting surface of the sidewall.

24. In a method according to claim 20, wherein said tread portions include tread surfaces, the additional steps of arranging said tread surfaces to contact the adjacent surfaces of said sidewalls.

25. In a method according to claim 20, the additional steps of arranging said arrays in two parallel spaced apart sets, each set comprising at least two arrays of outer and inner arrays, and arranging said sidewalls of said inner array in said second overlapping relation to overlap the adjacent sidewalls of said outer array, arranging said arrays relative to each other and the roadway so that said second overlapped relation is located generally in the track lanes of said roadway, and arranging for each said set of arrays a said floor member beneath said separate sets.

26. In a method according to claim 20, the additional steps of arranging said arrays in at least two closely adjacent sets made up of outer and adjacent inner arrays, arranging said sidewalls of said outer and inner arrays in said first and said second overlapping relations and arranging said sidewalls of said inner adjacent arrays with respect to each other in an overlapping relation and securing said overlapped sidewalls at their overlapping surfaces.

27. In a method according to claim 20, wherein the temporary roadway is used where loaded vehicles will generally travel in one direction, and each sidewall forms a ramp surface, the additional step of arranging said arrays so that the lower ends of said ramp surfaces in said first overlapped relation point in the direction of said one direction.

28. In a method according to claim 20, wherein said sidewalls have bead and side surface portions, the additional steps of arranging said sidewalls in said first overlapped relation to that said bead portions provide bridge portions for the center openings of said sidewalls in said first overlapped relationship and said side surface portions provide an inclined ramp for a vehicle passing over said roadway in a certain direction of travel thereof.

29. In a method according to claim 20, the additional step of:

passing said tire tread portions through at least some of the center openings of said sidewalls of said arrays.

* * * * *